US008431299B2

(12) United States Patent
Matsuura

(10) Patent No.: US 8,431,299 B2
(45) Date of Patent: Apr. 30, 2013

(54) DEVELOPER, IMAGE FORMING UNIT AND IMAGE FORMING APPARATUS

(75) Inventor: Yuki Matsuura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 492 days.

(21) Appl. No.: 12/706,140

(22) Filed: Feb. 16, 2010

(65) Prior Publication Data

US 2010/0215408 A1 Aug. 26, 2010

(30) Foreign Application Priority Data

Feb. 24, 2009 (JP) ..... 2009-040927

(51) Int. Cl.
*G03G 9/00* (2006.01)

(52) U.S. Cl.
USPC ..... 430/108.6; 430/108.7; 430/109.1

(58) Field of Classification Search ..... 430/108.6, 430/108.7, 109.1, 109.3, 110.4
See application file for complete search history.

(56) References Cited

U.S. PATENT DOCUMENTS 5,968,701 A * 10/1999 Onuma et al. ..... 430/108.22
6,924,073 B2 * 8/2005 Higuchi et al. ..... 430/108.4

FOREIGN PATENT DOCUMENTS

JP 63-271372 A 11/1988
JP 06-118703 A 4/1994
JP 10063035 A * 3/1998
JP 10-087837 A 4/1998
JP 11-242355 A 9/1999
JP 2003-035968 A 2/2003
JP 2003-167382 A 6/2003
JP 2004-004693 A 1/2004

OTHER PUBLICATIONS

English Translation of JP 10063035.*

* cited by examiner

*Primary Examiner* — Stewart Fraser
(74) *Attorney, Agent, or Firm* — Marvin A. Motsenbocker; MOTS Law, PLLC

(57) ABSTRACT

A developer has a molecular weight distribution of its tetrahydrofuran soluble portion measured by a gel permeation chromatography. In the molecular weight distribution, the main peak is in a range from $2\times10^3$ to $3\times10^4$ weight-average molecular weight (Mw), the shoulder peak is in a range from 200 to 500 Mw, and a half-value width of the main peak is equal to or less than 50000. A glass-transition temperature Tg of the developer is a range from 55° C. to 80° C.

8 Claims, 4 Drawing Sheets

FIG. 3

| | INTERMEDIATE PARTICLE | TONER | SHOULDER PEAK POSITION | MAIN PEAK POSITION | HALF-VALUE WIDTH OF MAIN PEAK | Tg [°C] | FIXING TEMPERATURE [°C] | | | | BLOCKING AFTER PRESERVATION |
|---|---|---|---|---|---|---|---|---|---|---|---|
| | | | | | | | PRINTER 1 | PRINTER 2 | PRINTER 3 | PRINTER 4 | |
| COMPARATIVE EXAMPLE 1-1 | α | A | 100 | 1968 | 58692 | 52.4 | HOT OFFSET | 145 | 155 | 165 | EXIST |
| COMPARATIVE EXAMPLE 1-2 | α | B | 185 | 1894 | 56925 | 62.5 | HOT OFFSET | 155 | 165 | 175 | EXIST |
| COMPARATIVE EXAMPLE 1-3 | α | C | 129 | 1856 | 50000 | 82.3 | HOT OFFSET | 155 | 165 | 175 | EXIST |
| EXAMPLE 1-1 | β | D | 200 | 2000 | 50000 | 55.0 | HOT OFFSET | 145 | 155 | 185 | NONE |
| EXAMPLE 1-2 | β | E | 243 | 2566 | 50000 | 65.2 | HOT OFFSET | 155 | 165 | 185 | NONE |
| EXAMPLE 1-3 | β | F | 200 | 2000 | 50000 | 80.0 | 145 | 165 | 175 | 195 | NONE |
| EXAMPLE 1-4 | γ | G | 500 | 2000 | 50000 | 55.0 | HOT OFFSET | 155 | 165 | 185 | NONE |
| EXAMPLE 1-5 | γ | H | 496 | 2312 | 49856 | 61.5 | 145 | 165 | 175 | 195 | NONE |
| EXAMPLE 1-6 | γ | I | 500 | 2000 | 50000 | 80.0 | 145 | 165 | 175 | 195 | NONE |
| EXAMPLE 1-7 | δ | J | 200 | 30000 | 50000 | 55.0 | HOT OFFSET | 155 | 165 | 185 | NONE |
| EXAMPLE 1-8 | δ | K | 213 | 29856 | 48569 | 65.5 | 145 | 165 | 175 | 195 | NONE |
| EXAMPLE 1-9 | δ | L | 200 | 30000 | 50000 | 80.0 | 145 | 165 | 175 | 195 | NONE |
| EXAMPLE 1-10 | ε | M | 500 | 30000 | 50000 | 55.0 | HOT OFFSET | 155 | 165 | 185 | NONE |
| EXAMPLE 1-11 | ε | N | 498 | 29865 | 47568 | 63.1 | HOT OFFSET | 155 | 165 | 185 | NONE |
| EXAMPLE 1-12 | ε | O | 500 | 30000 | 50000 | 80.0 | 145 | 165 | 175 | 195 | NONE |
| COMPARATIVE EXAMPLE 1-4 | ζ | P | 200 | 30000 | 50124 | 55.9 | 155 | 175 | 185 | 205 | NONE |
| COMPARATIVE EXAMPLE 1-5 | ζ | Q | 232 | 32142 | 50698 | 62.3 | 155 | 175 | 185 | 195 | NONE |
| COMPARATIVE EXAMPLE 1-6 | ζ | R | 200 | 33562 | 50008 | 82.3 | 165 | 185 | 195 | 205 | NONE |
| COMPARATIVE EXAMPLE 1-7 | η | S | 500 | 44325 | 49856 | 55.2 | 155 | 175 | 185 | 195 | NONE |
| COMPARATIVE EXAMPLE 1-8 | η | T | 521 | 46355 | 56897 | 63.5 | 165 | 185 | 195 | 205 | NONE |
| COMPARATIVE EXAMPLE 1-9 | η | U | 500 | 43562 | 52456 | 83.6 | 165 | 185 | 195 | 205 | NONE |

FIG. 4

| | TONER | FIXING TEMPERATURE [°C] | | | | BLOCKING AFTER PRESERVATION | FLOW TESTER FUSING POINT [°C] |
|---|---|---|---|---|---|---|---|
| | | PRINTER 1 | PRINTER 2 | PRINTER 3 | PRINTER 4 | | |
| EXAMPLE 2-1 | D | HOT OFFSET | 145 | 155 | 185 | NONE | 110 |
| EXAMPLE 2-2 | E | HOT OFFSET | 155 | 165 | 185 | NONE | 123 |
| EXAMPLE 2-3 | F | 145 | 155 | 165 | 195 | NONE | 140 |
| COMPARATIVE EXAMPLE 2-1 | G | HOT OFFSET | 165 | 175 | 185 | NONE | 143 |
| COMPARATIVE EXAMPLE 2-2 | H | 145 | 165 | 175 | 195 | NONE | 146 |
| COMPARATIVE EXAMPLE 2-3 | I | 145 | 165 | 175 | 195 | NONE | 148 |
| EXAMPLE 2-4 | J | HOT OFFSET | 155 | 165 | 185 | NONE | 136 |
| COMPARATIVE EXAMPLE 2-4 | K | 145 | 165 | 175 | 195 | NONE | 143 |
| EXAMPLE 2-5 | L | 145 | 155 | 165 | 195 | NONE | 138 |
| EXAMPLE 2-6 | M | HOT OFFSET | 155 | 165 | 185 | NONE | 140 |
| COMPARATIVE EXAMPLE 2-5 | N | HOT OFFSET | 165 | 175 | 185 | NONE | 146 |
| COMPARATIVE EXAMPLE 2-6 | O | 145 | 165 | 175 | 195 | NONE | 145 |

DEVELOPER, IMAGE FORMING UNIT AND IMAGE FORMING APPARATUS

CROSS REFERENCE TO RELATED APPLICATIONS

This application claims priority based on 35 USC 119 from prior Japanese Patent Application No. 2009-040927 filed on Feb. 24, 2009, entitled "Developer, Image Forming Unit, and Image Forming Apparatus", the entire contents of which are incorporated herein by reference.

BACKGROUND OF THE INVENTION

1. Field of the Invention

The invention relates to a developer, an image forming unit, and an image forming apparatus.

2. Description of Related Art

In an image forming apparatus such as a copy machine, a facsimile machine, an MFP (multi-functional printer or multi-functional peripheral) and the like, for example, in a printer, a charging roller uniformly charges a photosensitive drum, and an LED head exposes light onto the charged photosensitive drum to form an electrostatic latent image on the charged photosensitive drum, and a developing unit develops the electrostatic latent image to from a toner image on the charged photosensitive drum. The developing unit includes a developing roller, a toner supplying roller, a development blade, and the like. In the developing unit, the toner supplying roller supplies toner serving as a developer to the developing roller, the development blade meters the toner on the developing roller to form a thin toner layer on the developing roller. The toner on developing roller is attracted to the electrostatic latent image on the photosensitive drum so that the toner image is formed on the photosensitive drum.

Then, a transfer roller transfers the toner image from the photosensitive drum to a paper sheet, and a fixing unit fixes the toner image to the paper sheet.

In the printer, an image forming unit is composed of the photosensitive drum, the charging roller, the developing roller, the toner supplying roller, the development blade and the like. When just one of the photosensitive drum, the charging roller, the developing roller, the toner supplying roller, the development blade, and the like reaches the end of its life, a printer controller determines that the image forming unit reaches the end of life. The entire image forming unit is then replaced with a new image forming unit.

Over a long period of time, the toner may become degraded by being rubbed and/or pressed by means of the developing roller, the toner supplying roller, the development blade, or the like. Depending on the condition of use of the printer, the toner property may not last until the end of life of the image forming unit.

To overcome this problem, a printer capable of preventing such toner degradation by using a toner whose glass-transition point (glass-transition temperature) is equal to or greater than 75° C. is provided (for example, Japanese Patent Application Laid-Open No. 11-242355).

SUMMARY OF THE INVENTION

Conventional image forming units have difficulty maintaining image quality for long periods of time.

An object of the invention is to maintain acceptable image quality in long periods of time.

A first aspect of the invention is a developer including: a toner including toner mother particle comprising at least a binder resin; and an additive agent on the surface of the toner mother particle. Measurement of the molecular weight distribution of the tetrahydrofuran soluble portion of the toner, measured by gel permeation chromatography, yields a main peak in the range from $2\times10^3$ to $3\times10^4$ weight-average molecular weight (Mw) and a shoulder peak in the range from 200 to 500 weight-average molecular weight (Mw). The half-value width of the main peak is equal to or less than 50000 weight-average molecular weight (Mw). The glass-transition temperature, Tg, of the toner measured by differential scanning calorimeter DSC is in a range from 55° C. to 80° C.

A second aspect of the invention is an image forming unit configured to print images using the developer of the first aspect.

A third aspect of the invention is an image forming apparatus including: an image forming unit configured to print images using the developer of the first aspect, a transfer member configured to transfer the developer image formed by the image forming unit onto a medium, and a fixing unit configured to fix to the medium the developer image that is transferred to the medium.

A fourth aspect of the invention is a developer cartridge including the developer of the first aspect, and a developer cartridge body containing the developer therein.

The aspects of the invention result in maintenance of acceptable image quality for long periods of time.

BRIEF DESCRIPTION OF THE DRAWINGS

FIG. 3 is a table of toner characteristics according to the first embodiment.

FIG. 4 is a table of flow tester measurement results according to a second embodiment of the invention.

DETAILED DESCRIPTION OF THE EMBODIMENTS

Hereinafter, embodiments of the invention will be described in detail with reference to the drawings. The following description will be made for a printer serving as the image forming apparatus.

Figure 1:
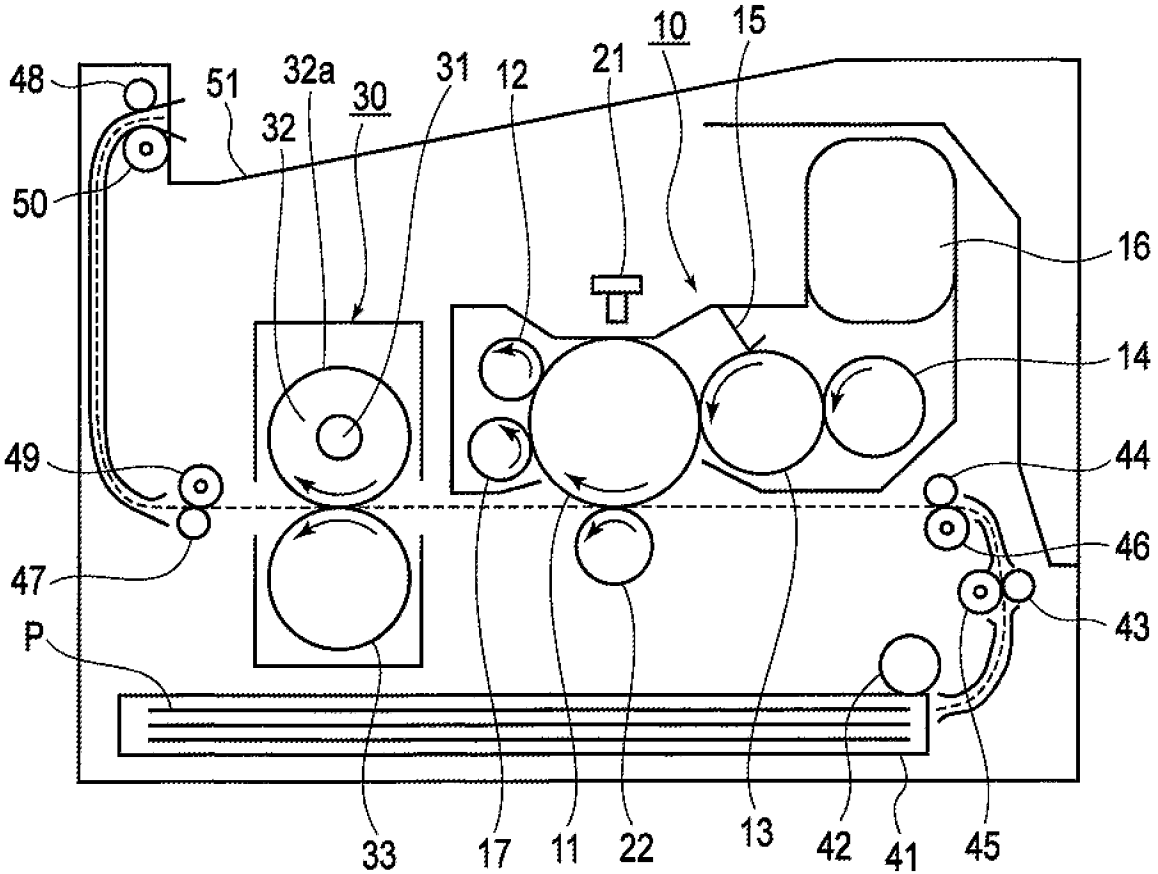
FIG. 1 is a conceptual diagram of a printer according to a first embodiment of the invention.

FIG. 1 is a conceptual diagram of a first embodiment of the invention.

As shown in FIG. 1, a printer includes image forming unit 10 serving as an image former. Image forming unit 10 includes: photosensitive drum 11 serving as an image carrier; charging roller 12 (a charging unit) disposed in contact with the surface of photosensitive drum 11 and configured to uniformly charge the surface of photosensitive drum 11; developing roller 13 serving as a developer carrier disposed in contact with the surface of photosensitive drum 11 and configured to develop a latent image or electrostatic latent image formed on the surface of photosensitive drum 11, thereby forming a toner image (a developer image) on the surface of the photosensitive drum; toner supplying roller 14 (a developer supplying member) disposed in contact with developing roller 13 and configured to supply toner (developer) onto developing roller 13; development blade 15 serving as a developer layer forming member disposed such that its edge is in contact with developing roller 13 and configured to form a toner layer on developing roller 13; toner cartridge 16 serving as a developer container (a developer cartridge) which contains the toner therein; and cleaning roller 17 (a cleaning member) configured to scrape and remove, from photosensitive drum 11, the toner that remains on photosensitive drum 11 after image transfer. Image forming unit 10 is detachably attached to the printer body or the apparatus body. Note that the developing unit (developing device) is composed of developing roller 13, toner supplying roller 14, development blade 15, and the like.

LED head 21 (an exposure unit) is disposed above photosensitive drum 11 and faces photosensitive drum 11. Image transfer roller 22 (an image transferring member) is disposed beneath photosensitive drum 11 and faces photosensitive drum 11. LED head 21 is configured to form an electrostatic latent image on the surface of photosensitive drum 11. Image transfer roller 22 is made of conductive material such as conductive rubber or the like. Image transfer roller 22 is configured to transfer the toner image from photosensitive drum 11 to a paper sheet (medium).

Paper cassette 41 (a media container), which contains stacked paper sheets P, is provided at the lower portion of the printer. Hopping roller 42 (feeding roller), which is configured to separate and feed paper sheets P one by one, is provided in front and top of paper cassette 41.

Pinch roller 43 and conveying roller 45 are in contact with each other and are provided downstream of hopping roller 42 in the direction that paper sheet P is conveyed. Pinch roller 44 and resist roller 46 are in contact with each other and are provide downstream of pinch roller 43 and conveying roller 45 in the conveying direction of paper sheet P. Pinch roller 43 and conveying roller 45 comprise a first pair of rollers configured to convey paper sheet P sandwiching paper sheet P there-between. Pinch roller 44 and resist roller 46 comprise a second pair of rollers and are configured to correct any skew of paper sheet P and to then convey paper sheet P toward an image transfer section, which is a contact region between photosensitive drum 11 and image transfer roller 22.

Fixing unit 30 (a fixing device) is disposed downstream of the image transfer section in the conveying direction of paper sheet P. Fixing unit 30 is configured to heat and press the transferred toner image that was transferred to paper sheet P so as to fix the toner image to paper sheet P. Fixing unit 30 includes heat roller 32 (serving as a fuser member or a first roller) and backup roller 33 (serving as a second roller or a press member). Heat roller 32 is configured to heat the toner image that is transferred on paper sheet P. Backup roller 33 is configured to be in pressure-contact with heated roller 32. Heat roller 32 includes a cylindrical aluminum pipe coated by a fluororesin such as PFA, PTFE, or the like. Halogen lamp 31 (serving as a heater or a heating member) is provided in the pipe. Backup roller 33 is a compliant roller. Note that the width of the nip between heat roller 32 and backup roller 33 is 4.5 mm. The circumferential velocity of heat roller 32 is the liner velocity of fixing unit 30.

Pinch roller 47 and conveying roller 49 are in contact with each other and are provided downstream of fixing unit 30 in the conveying direction of paper sheet P. Pinch roller 48 and discharging roller 50 are in contact with each other and are provided downstream of pinch roller 47 and conveying roller 49 in the conveying direction. Pinch roller 47 and conveying roller 49 comprise a third pair of rollers and are configured to convey paper sheet P there-between. Pinch roller 48 and discharging roller 50 comprise a fourth pair of rollers and are configured to discharge paper sheet P to stacker 51 provided on the outside of the printer body.

Gears (not shown) such as a photosensitive drum gear, a charging roller gear, a developing roller gear, a toner supplying roller gear, a transfer roller gear, a cleaning roller gear, and a heat roller gear are fixed respectively at one axial end of photosensitive drum 11, charging roller 12, developing roller 13, toner supplying roller 14, cleaning roller 17, image transfer roller 22 and heat roller 32 (except for, backup roller 33) by press-fit or other means, so that an un-illustrated drive motor (a drive source) rotates drum 11 and rollers 12, 13, 14, 17, 22, and 32 via those gears. An idle gear is provided between the developing roller gear and the toner supplying roller gear so that developing roller 13 and toner supplying roller 14 rotate in the same direction.

Further, hopping roller 42, conveying rollers 45 and 49, resist roller 46, and discharging roller 50 are connected to the drive motor via gears (not shown) so that the rotation of the drive motor is transmitted and rotates these rollers.

Next, operation of the printer having the above configuration will be described.

Upon a print instruction transmitted to a controller (not shown), the drive motor is activated to rotate and the rotation of the drive motor is transmitted to the photosensitive drum gear (not shown) via several gears (not shown), so that photosensitive drum 11 is rotated by the drive motor. The rotation of the photosensitive drum gear is transferred to the developing roller gear, so that developing roller 13 rotates. The rotation is transmitted from the developing roller gear to the toner supplying roller gear via the idle gear so that the toner supplying roller 14 rotates.

Further, the rotation of the photosensitive drum gear is transmitted to the charging roller gear so that charging roller 12 rotates. The rotation of the photosensitive drum gear is also transmitted to the cleaning roller gear so that the cleaning roller 17 rotates. The rotation of the drum gear is also transmitted to the image transferring roller gear so that the image transfer roller 22 rotates.

Further, the rotation of the drive motor is transmitted via other gears (not shown) provided in the printer body to the heat roller gear, so that heat roller 32 rotates. The rotation of heat roller 32 causes backup roller 33 to rotate with the heat roller 32. Note that photosensitive drum 11, charging roller 12, developing roller 13, toner supplying roller 14, cleaning roller 17, image transfer roller 22, heat roller 32, and backup roller 33 rotate in directions indicated by the arrows shown in FIG. 1, respectively.

When the drive motor is activated to rotate, the controller applies voltages to photosensitive drum 11, charging roller 12, developing roller 13, toner supplying roller 14, image transfer roller 22, and the like.

As a voltage is applied to charging roller 12, the surface of photosensitive drum 11 is charged uniformly. Next, when photosensitive drum 11 is rotated to a position where a charged surface area of photosensitive drum 11 is opposed to LED head 21, LED head 21 is activated to emit light according to image data transmitted from the controller to LED head 21 so as to form an electrostatic latent image on the surface of photosensitive drum 11. When a voltage is applied to the developing roller 13 and photosensitive drum 11 is rotated to a position where the electrostatic latent image formed on the photosensitive drum 11 is opposed to developing roller 13, a part of the toner layer that is formed on developing roller 13 by development blade 15 is attracted to photosensitive drum 11 due to a voltage potential difference between the electrostatic latent image formed on photosensitive drum 11 and developing roller 13, so that a toner image is formed on photosensitive drum 11.

Paper sheet P in paper cassette 41 is fed by hopping roller 42 to pinch roller 43 and conveying roller 45, conveyed by pinch roller 43 and conveying roller 45 to pinch roller 44 and resist roller 46, and then conveyed to the image transfer section as its skew is corrected by pinch roller 44 and resist roller 46.

Next, the toner image on image photosensitive drum 11 is transferred from image photosensitive drum 11 to paper sheet P in the image transfer section by using image transfer roller 22. Then, paper sheet P that has the toner image thereon is conveyed to fixing unit 30. In fixing unit 30, paper sheet P that has the transferred toner image thereon is heated by halogen lamp 31 of heat roller 32 and pressed by backup roller 33, so that the toner image is fixed onto paper sheet P. Note that toner that remains on photosensitive drum 11 after the image transfer process is removed from photosensitive drum 11 by cleaning roller 17 and collected into a waste toner container (not shown) provided in toner cartridge 16.

Paper sheet P is further conveyed by pinch roller 47 and conveying roller 49 and by pinch roller 48 and discharging roller 50 and then discharged and stacked on stacker 51 which is provided on the printer body.

Note that photosensitive drum 11, charging roller 12, developing roller 13, toner supplying roller 14, development blade 15 and the like comprise image forming unit 10. The controller determines that the image forming unit 10 reaches the end of its operating life when at least one of photosensitive drum 11, charging roller 12, developing roller 13, toner supplying roller 14, development blade 15, and the like reaches the end of the life, and then the entire image forming unit is to be replaced with a new image forming unit.

However, as the printer is used over a long period of time, the toner is degraded by being rubbed and/or pressed by developing roller 13, toner supplying roller 14, development blade 15, or the like. Depending on the conditions of use of the printer, it may be difficult to maintain acceptable toner properties until the end of the life of the image forming unit.

Accordingly, using a toner having a high glass-transition point (glass-transition temperature) may overcome the above problem. However, such toner having a high glass-transition point more difficult to fix or fuse.

The present embodiment uses a suspension polymerization toner to maintain its durability and preventing deterioration of its fixing properties.

First, 2 parts by weight (pbw) of low-molecular-weight polyethylene, 1 pbw of a charge control agent "AIZEN SPILON BLACK TRH" (manufactured by Hodogaya Chemical Co., Ltd.), 6 pbw of carbon black (Printex L, manufactured by Degussa Corporation), and 1 pbw of 2,2'-azobisisobutyronitrile are added to 65.5 pbw of styrene and 22.5 pbw of n-butyl acrylate, and then are dispersed at 15° C. for 10 hours in Attriter "MA-01SC" (manufactured by Mitsui Mitsuike Chemical Plants Co. Ltd.), thereby obtaining a polymerized composition. 180 pbw of ethanol in which 8 pbw of polyacrylic acid and 0.35 pbw of divinylbenzene are dissolved is prepared, and 600 pbw of distilled water is added therein, thereby obtaining a dispersion medium for polymerizing.

Next, the polymerized composition is added to the dispersion medium and then dispersed at 15° C. and 8000 rotations for 10 minutes in T.K. Homomixer "Model M" (manufactured by Tokushukikakogyo), thereby obtaining a dispersion solution.

Next, 1-liter of the resulting dispersion solution is put in a separable flask and reacted at 85° C. for 12 hours while being agitated in a nitrogen stream at 100 [r.p.m.].

The product (dispersoid) that is obtained by the polymerization reaction of the polymerized composition in the above process is hereinafter referred to as intermediate particle α.

Intermediate particle β is a dispersoid that is obtained by the same process as that of intermediate particle α except for using 67.5 pbw of styrene and 4 pbw of low-molecular-weight polyethylene. Intermediate particle γ is a dispersoid that is obtained by the same process as that of intermediate particle α except for using 67.5 pbw of styrene and 4 pbw of low-molecular-weight polypropylene. Intermediate particle δ is a dispersoid that is obtained by the same process as that of intermediate particle α except for using 77.5 pbw of styrene and 4 pbw of low-molecular-weight polyethylene. Intermediate particle ϵ is a dispersoid that is obtained by the same process as that of intermediate particle α except for using 77.5 pbw of styrene and 4 pbw of low-molecular-weight polypropylene. Intermediate particle ζ is a dispersoid that is obtained by the same process as that of intermediate particle α except for using 80 pbw of styrene and 4 pbw of low-molecular-weight polyethylene. Intermediate particle η is a dispersoid that is obtained by the same process as that of intermediate particle α except for using 85 pbw of styrene and 4 pbw of low-molecular-weight polypropylene.

As described above, intermediate particles α to η, whose styrene amounts are different from one another, are obtained. That is, their styrene/acrylic ratios are different from one another.

Next, a water emulsion is prepared by using an ultrasonic oscillator "US-150" (manufactured by NIHONSEIKI KAISHA Ltd.), the water emulsion being made of 9.25 pbw of methyl methacrylate, 0.75 pbw of n-butyl acrylate, 0.5 pbw of 2,2'-azobisisobutyronitrile, 0.1 pbw of sodium lauryl sulfate, 80 pbw of water. 9 pbw of the water emulsion is dropped to each aqueous suspension of intermediate particle α to η, thereby swelling each intermediate particle α to η. Note that when these particles are observed with an optical microscope shortly after dropping the water emulsion, no water emulsion drop appears. This indicates the swelling is completed in a very short time.

Then, a second stage of polymerization is performed, in which intermediate particles α to η are reacted for different reacting (heating) periods of time while being agitated in nitrogen. Some reacted particles are obtained by reacting intermediate particles α to η at 85° C. for 9 hours. Other reacted particles are obtained by reacting intermediate particles α to η at 85° C. for 10 hours. Other reacted particles are obtained by reacting intermediate particles α to η at 85'C for 11 hours.

Then, after cooling such reacted particles, each dispersion medium is dissolved in a 0.5 N hydrochloric acid aqueous solution, filtered, washed with water, and air-dried. The dried material is further dried at a low pressure of 10 mmHg at 40° C. for 10 hours and air-classified with an air-classifier, thereby obtaining each mother particle, which is a non-additive toner having an volume average particle diameter of 7.0 μm.

Note that the particle diameter of each mother particle is measured using 30,000 counts of a particle sizing and counting analyzer "Coulter Multilizer III" (manufactured by Beckman Coulter, Inc.) with an aperture diameter of 100 μm, thereby obtaining the volume average particle diameter of each mother particle.

Next, 1.8 pbw of "AEROSIL RY50" (manufactured by AEROSIL JAPAN Co., Ltd.) and 0.1 pbw of oxidized titanium"TTO-51 (A)" (manufactured by Ishihara Sangyo Kaisha, Ltd.) having particle diameter of 10 nm are added to 100 pbw of each mother particle, and mixed for 25 minutes, thereby obtaining toners A to U.

Note that a method of manufacturing toners A to U is not limited to the above description. Toners A to U may be manufactured using intermediate particles α to η by, for example, an emulsion polymerization method, a comminution method, or the like.

Toners A, D, G, J, M, P, and S were obtained by reacting intermediate particles α to η at 85° C. for 9 hours in the second stage of polymerization. Toners B, E, H, K, N, Q, and T were obtained by reacting intermediate particles α to η at 85° C. for 10 hours in the second stage of polymerization. Toner C, F, I, L, O, R, and U were obtained by reacting intermediate particles α to η at 85° C. for 11 hours in the second stage of polymerization.

Next, measurement of the molecular weight distribution of each toner A to U was carried out using "Shimazu GPC system" (manufactured by Shimazu Corporation). For this measurement, each toner A to U was dissolved to tetrahydrofuran (THF) serving as an eluant, and separated into the tetrahydrofuran soluble portion and the tetrahydrofuran insoluble portion by a filter to obtain the tetrahydrofuran soluble portion, and a molecular weight distribution of the tetrahydrofuran soluble portion was measured by gel permeation chromatography.

For this measurement, two columns "GPC KF-806L (inner diameter of 8.0 mm, length of 300 mm)" (manufactured by Showa Denko K.K.) and one column "GPC KF-803L (which has the inner diameter of 8.0 mm and the length of 300 mm)" (manufactured by Showa Denko K.K.) were used. The measurement of the molecular weight distribution was carried out using an IR detector in a condition having the sample concentration of 1%, the flow rate of 1.0 mL/min., the column temperature of 40° C., and sample injection amount of 200 μl.

Figure 2:
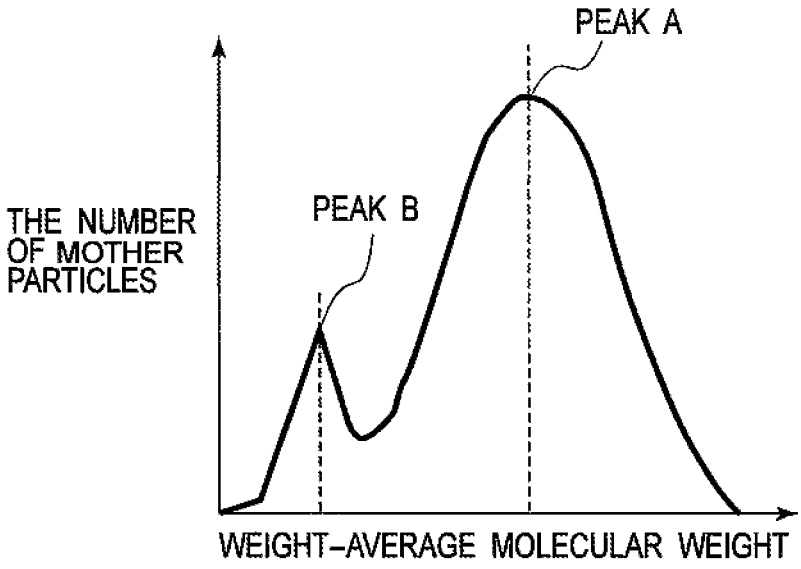
FIG. 2 is a graph of a molecular weight distribution according to the first embodiment.

FIG. 2 is a graph of the molecular weight distribution according to the first embodiment. In FIG. 2, the horizontal axis indicates an exponent of the weight-average molecular weight and the vertical axis indicates the number of the mother particles. On the horizontal axis, the left side is a lower molecular weight side and the right side is a higher molecular weight side. In FIG. 2, peak A shows the position of the main peak (referred to as the main peak position), peak B shows a position of the shoulder peak (referred to as the shoulder peak position). The half-value width of peak A is referred to as the half-value width of the main peak. Either of the main peak and the shoulder peak is a point of a local maximum (which is the highest point in a section of the graph, where the slope is changed from positive to negative). The main peak is the greatest one of the local maximums.

The characteristics of toners A to U are controlled by selecting the styrene/acrylic ratio of intermediate particles α to η and selecting the reaction time of intermediate particles α to η. Specifically, when intermediate particle α to η have a higher styrene/acrylic ratio, the position of the main peak, which is the position where the greatest number of mother particles exist, is shifted to low molecular weight side in the molecular weight distribution. When the reaction time of intermediate particle α to η is longer, glass-transition point Tg of toner A to U is greater.

Note that the characteristics of toners A to U can be controlled by varying the molar weight of other component of intermediate particles α to η.

Toner A had, in its molecular weight distribution, the main peak at 1968 weight-average molecular weight (Mw) and the shoulder peak or the small peak at 100 weight-average molecular weight (Mw). The half-value width of the main peak, which is the peak width at the half-height of the main peak, of toner A was 58692.

Next, glass-transition point Tg of toner A to U was measured by differential scanning calorimeter DSC "UNIX-DSC7" (manufactured by PerkinElmer Japan Co., Ltd.). This measurement of glass-transition point Tg was carried out in a condition where the temperature was increased from 20° C. to 200° C. at the temperature increase rate of 10 [° C./min]. Note that differential scanning calorimeter DSC obtains a function showing the amount of the energy required to heat each toner A to U. The curve of the function that is drawn in the graph having the horizontal axis indicating the temperature and the vertical axis indicating the heat capacity has a valley-shape having the bottom (the absolute minimum) where the heat capacity is the smallest. The curve shows that the heat capacity increase as the temperature goes down or goes up from the point of the bottom. The temperature at the bottom (the absolute minimum) of the curve is glass-transition point (glass-transition temperature) Tg.

Next, the toner characteristics will be described.

FIG. 3 is a table showing the toner characteristics of the first embodiment of the invention.

In the table, comparison examples 1-1 to 1-3, examples 1-1 to 1-12, and comparison examples 1-4 to 1-9 correspond to respective toners A to U and also correspond to intermediate particles α to η. The table shows the shoulder peak position, the main peak position, the half-value width of the main peak, glass-transition point Tg, the fixing temperature which is a temperature where the fixation ratio is equal to or higher than 80%, and existence or nonexistence of the blocking when toner A to U is preserved, of each toner A to U.

The shoulder peak position influences the characteristic of each toner A to U at the low temperature. As the main peak position and the shoulder peak position are shifted toward the low molecular weight side and glass-transition point Tg is shifted toward the low temperature side, the fixing property increases at the low fixing temperature but blocking occurs more often if the toner is preserved under high temperature. A toner that has a narrow half-value width of the main peak has a narrow range of temperature where the fixing property and the preservation property are high, but a toner that has a wide half-value width of the main peak has the preservation property which depends on the weight-average molecular weight values of the main peak and the shoulder peak.

As described above, toner A (comparative example 1-1) had the main peak at 1968 weight-average molecular weight (Mw) and the shoulder peak at 100 weight-average molecular weight (Mw) in the molecular weight distribution, the half-value width of the main peak of 58692, and glass-transition point Tg of 52.4° C.

Toner B (comparative example 1-2) had the main peak at 1894 weight-average molecular weight (Mw) and the shoulder peak at 185 weight-average molecular weight (Mw) in the molecular weight distribution, the half-value width of the main peak of 56925, and glass-transition point Tg of 62.5° C.

Toner C (comparative example 1-3) had the main peak at 1856 weight-average molecular weight (Mw) and the shoulder peak at 129 weight-average molecular weight (Mw) in the molecular weight distribution, the half-value width of the main peak of 50000, and glass-transition point Tg of 82.3° C.

Toner D (example 1-1) had the main peak at 2000 weight-average molecular weight (Mw) and the shoulder peak at 200 weight-average molecular weight (Mw) in the molecular weight distribution, the half-value width of the main peak of 50000, and glass-transition point Tg of 55.0° C.

Toner E (example 1-2) had the main peak at 2566 weight-average molecular weight (Mw) and the shoulder peak at 243 weight-average molecular weight (Mw) in the molecular weight distribution, the half-value width of the main peak of 50000, and glass-transition point Tg of 65.2° C.

Toner F (example 1-3) had the main peak at 2000 weight-average molecular weight (Mw) and the shoulder peak at 200 weight-average molecular weight (Mw) in the molecular weight distribution, the half-value width of the main peak of 50000, and glass-transition point Tg of 80.0° C.

Toner G (example 1-4) had the main peak at 2000 weight-average molecular weight (Mw) and the shoulder peak at 500 weight-average molecular weight (Mw) in the molecular weight distribution, the half-value width of the main peak of 50000, and glass-transition point Tg of 55.0° C.

Toner H (example 1-5) had the main peak at 2312 weight-average molecular weight (Mw) and the shoulder peak at 496 weight-average molecular weight (Mw) in the molecular weight distribution, the half-value width of the main peak of 49856, and glass-transition point Tg of 61.5° C.

Toner I (example 1-6) had the main peak at 2000 weight-average molecular weight (Mw) and the shoulder peak at 500 weight-average molecular weight (Mw) in the molecular weight distribution, the half-value width of the main peak of 50000, and glass-transition point Tg of 80.0° C.

Toner J (example 1-7) had the main peak at 30000 weight-average molecular weight (Mw) and the shoulder peak at 200 weight-average molecular weight (Mw) in the molecular weight distribution, the half-value width of the main peak of 50000, and glass-transition point Tg of 55.0° C.

Toner K (example 1-8) had the main peak at 29856 weight-average molecular weight (Mw) and the shoulder peak at 213 weight-average molecular weight (Mw) in the molecular weight distribution, the half-value width of the main peak of 48569, and glass-transition point Tg of 65.5° C.

Toner L (example 1-9) had the main peak at 30000 weight-average molecular weight (Mw) and the shoulder peak at 200 weight-average molecular weight (Mw) in the molecular weight distribution, the half-value width of the main peak of 50000, and glass-transition point Tg of 80.0° C.

Toner M (example 1-10) had the main peak at 30000 weight-average molecular weight (Mw) and the shoulder peak at 500 weight-average molecular weight (Mw) in the molecular weight distribution, the half-value width of the main peak of 50000, and glass-transition point Tg of 55.0° C.

Toner N (example 1-11) had the main peak at 29865 weight-average molecular weight (Mw) and the shoulder peak at 498 weight-average molecular weight (Mw) in the molecular weight distribution, the half-value width of the main peak of 47568, and glass-transition point Tg of 63.1° C.

Toner O (example 1-12) had the main peak at 30000 weight-average molecular weight (Mw) and the shoulder peak at 500 weight-average molecular weight (Mw) in the molecular weight distribution, the half-value width of the main peak of 50000, and glass-transition point Tg of 80.0° C.

Toner P (comparative example 1-4) had the main peak at 30000 weight-average molecular weight (Mw) and the shoulder peak at 200 weight-average molecular weight (Mw) in the molecular weight distribution, the half-value width of the main peak of 50124, and glass-transition point Tg of 55.9° C.

Toner Q (comparative example 1-5) had the main peak at 32142 weight-average molecular weight (Mw) and the shoulder peak at 232 weight-average molecular weight (Mw) in the molecular weight distribution, the half-value width of the main peak of 50698, and glass-transition point Tg of 62.3° C.

Toner R (comparative example 1-6) had the main peak at 33562 weight-average molecular weight (Mw) and the shoulder peak at 200 weight-average molecular weight (Mw) in the molecular weight distribution, the half-value width of the main peak of 50008, and glass-transition point Tg of 82.3° C.

Toner S (comparative example 1-7) had the main peak at 44325 weight-average molecular weight (Mw) and the shoulder peak at 500 weight-average molecular weight (Mw) in the molecular weight distribution, the half-value width of the main peak of 49856, and glass-transition point Tg of 55.2° C.

Toner T (comparative example 1-8) had the main peak at 46355 weight-average molecular weight (Mw) and the shoulder peak at 521 weight-average molecular weight (Mw) in the molecular weight distribution, the half-value width of the main peak of 56897, and glass-transition point Tg of 63.5° C.

Toner U (comparative example 1-9) had the main peak at 43562 weight-average molecular weight (Mw) and the shoulder peak at 500 weight-average molecular weight (Mw) in the molecular weight distribution, the half-value width of the main peak of 52456, and glass-transition point Tg of 83.6° C.

Next, will be described the fixing property and the preservation property of each toner A to U upon printing with the toners A to U.

In printing, the liner velocity of developing roller 13 is set 189.2 mm/s, a normal paper (for example, Xerox 4200, 92 Bright, 20 Lb, Letter size) serving as a paper P is conveyed such that the two short sides of paper P are the lead and trail edges of paper P in the conveying direction of paper P.

A test pattern is printed ten times at different fixing temperatures increased by 10° C. from 145° C. to 205° C. The test pattern has five black solid squares of 1 cm×1 cm formed at 5 points on paper P, wherein the 5 points include: a left upper point (a position located 3 cm away from the left side of paper P and 3 cm away from the top side of paper P); a right upper point (a position located 3 cm away from the right side of paper P and 3 cm away from the top side of paper P); a center point; a left lower point (a position located 3 cm away from the left side of paper P and 3 cm away from the bottom side of paper P); and a right lower point (a position located 3 cm away from the right side of paper P and 3 cm away from the bottom side of paper P).

Next, the first printed paper of each fixing temperature is examined to calculate the fixation ratio thereof. Specifically, image densities of the five black solid squares are measured. Next, mending tape is placed over the five black solid squares on paper P, pressed to paper P by the baro of a flat-bottomed cylinder weight of 500 [g], and removed from paper P after the weight is removed. The image densities of the five black solid squares are then measured. Fixation ratio $\epsilon$ % is expressed by the equation $\epsilon$=Da/Db, wherein an average of the image densities of the five black solid squires before the mending tape is stuck thereto is referred to as Db, an average of the image densities of the five black solid squares after the mending tape is removed there-from is referred to as Da. A higher fixation ratio $\epsilon$ means a higher fixation property.

To find the toner preservative property, toner cartridges 16 containing 150 [g] of toners A to U therein are preserved in a condition of high temperature and high humidity (temperature of 50° C., humidity of 55%) for a predetermined period (one month in the embodiment) and disposed in an upright position, and then examined as to whether or not blocking (agglomeration) of toner A to U occurs.

Note that printer 1 uses heat roller 32 having an outer diameter of 20 mm, and a circumferential velocity of 115 mm/s. Printer 2 uses heat roller 32 having an outer diameter of 20 mm and a circumferential velocity of 162 mm/s. Printer 3 uses heat roller 32 having an outer diameter of 20 mm and a circumferential velocity of 189 mm/s. Printer 4 uses heat roller 32 having an outer diameter of 20 mm and a circumferential velocity of 210 mm/s.

Regarding toner A, when toner A was used in printer 1, hot offset (a phenomenon where fused toner is attached to heat roller 32) occurred; when toner A was used in printer 2, the fixation ratio was 80% at 145° C.; when toner A was used in printer 3, the fixation ratio was 80% at 155° C.; and when toner A was used in printer 4, the fixation ratio was 80% at 165° C. Regarding preservation of toner A, blocking thereof occurred. It is assumed that such blocking occurs because the glass-transition point Tg of toner A is low and the weight-average molecular weight of the shoulder peak position is low.

Regarding toner B (comparative example 1-2), when toner B was used in printer 1, hot offset occurred; when toner B was used in printer 2, the fixation ratio was 80% at 155° C.; when toner B was used in printer 3, the fixation ratio was 80% at 165° C., and when toner B was used in printer 4, the fixation ratio was 80% at 175° C. Regarding preservation of toner B, blocking thereof occurred.

Regarding toner C (comparative example 1-3), when toner C was used in printer 1, hot offset occurred; when toner C was used in printer 2, the fixation ratio was 80% at 155° C.; when toner C was used in printer 3, the fixation ratio was 80% at 165° C.; and when toner C was used in printer 4, the fixation ratio was 80% at 175° C. Regarding preservation of toner C, blocking thereof occurred.

Regarding toner D (example 1-1), when toner D was used in printer 1, hot offset occurred; when toner D was used in printer 2, the fixation ratio was 80% at 145° C.; when toner D was used in printer 3, the fixation ratio was 80% at 155° C.; and when toner D was used in printer 4, the fixation ratio was 80% at 185° C. Regarding preservation of toner D, no blocking thereof occurred.

Regarding toner E (example 1-2), when toner E was used in printer 1, hot offset occurred; when toner E was used in printer 2, the fixation ratio was 80% at 155° C.; when toner E was used in printer 3, the fixation ratio was 80% at 165° C.; and when toner E was used in printer 4, the fixation ratio was 80% at 185° C. Regarding preservation of toner E, no blocking thereof occurred.

Regarding toner F (example 1-3), when toner F was used in printer 1, the fixation ratio was 80% at 145° C.; when toner F was used in printer 2, the fixation ratio was 80% at 165° C.; when toner F was used in printer 3, the fixation ratio was 80% at 175° C.; and when toner F was used in printer 4, the fixation ratio was 80% at 195° C. Regarding preservation of toner F, no blocking thereof occurred.

Regarding toner G (example 1-4), when toner G was used in printer 1, hot offset occurred; when toner G was used in printer 2, the fixation ratio was 80% at 155° C.; when toner G was used in printer 3, the fixation ratio was 80% at 165° C.; and when toner G was used in printer 4, the fixation ratio was 80% at 185° C. Regarding preservation of toner G, no blocking thereof occurred.

Regarding toner H (example 1-5), when toner H was used in printer 1, the fixation ratio was 80% at 145° C.; when toner H was used in printer 2, the fixation ratio was 80% at 165° C.; when toner H was used in printer 3, the fixation ratio was 80% at 175° C.; and when toner H was used in printer 4, the fixation ratio was 80% at 195° C. Regarding preservation of toner H, no blocking thereof occurred.

Regarding toner I (example 1-5), when toner I was used in printer 1, the fixation ratio was 80% at 145° C.; when toner I was used in printer 2, the fixation ratio was 80% at 165° C.; when toner I was used in printer 3, the fixation ratio was 80% at 175° C.; and when toner I was used in printer 4, the fixation ratio was 80% at 195° C. Regarding preservation of toner I, no blocking thereof occurred.

Regarding toner J (example 1-7), when toner J was used in printer 1, hot offset occurred; when toner J was used in printer 2, the fixation ratio was 80% at 155° C.; when toner J was used in printer 3, the fixation ratio was 80% at 165° C.; and when toner J was used in printer 4, the fixation ratio was 80% at 185° C. Regarding preservation of toner J, no blocking thereof occurred.

Regarding toner K (example 1-8), when toner K was used in printer 1, the fixation ratio was 80% at 145° C., when toner K was used in printer 2, the fixation ratio was 80% at 165° C., when toner K was used in printer 3, the fixation ratio was 80% at 175° C., when toner K was used in printer 4, the fixation ratio was 80% at 195° C. Regarding preservation of toner K, no blocking thereof occurred.

Regarding toner L (example 1-9), when toner L was used in printer 1, the fixation ratio was 80% at 145° C.; when toner L was used in printer 2, the fixation ratio was 80% at 165° C.; when toner L was used in printer 3, the fixation ratio was 80% at 175° C.; and when toner L was used in printer 4, the fixation ratio was 80% at 195° C. Regarding preservation of toner L, no blocking thereof occurred.

Regarding toner M (example 1-10), when toner M was used in printer 1, hot offset occurred; when toner M was used in printer 2, the fixation ratio was 80% at 155° C.; when toner M was used in printer 3, the fixation ratio was 80% at 165° C.; and when toner M was used in printer 4, the fixation ratio was 80% at 185° C. Regarding preservation of toner M, no blocking thereof occurred.

Regarding toner N (example 1-11), when toner N was used in printer 1, hot offset occurred; when toner N was used in printer 2, the fixation ratio was 80% at 155° C.; when toner N was used in printer 3, the fixation ratio was 80% at 165° C.; and when toner N was used in printer 4, the fixation ratio was 80% at 185° C. Regarding preservation of toner N, no blocking thereof occurred.

Regarding toner O (example 1-12), when toner O was used in printer 1, the fixation ratio was 80% at 145° C.; when toner O was used in printer 2, the fixation ratio was 80% at 165° C.; when toner O was used in printer 3, the fixation ratio was 80% at 175° C.; and when toner O was used in printer 4, the fixation ratio was 80% at 195° C. Regarding preservation of toner O, no blocking thereof occurred.

Regarding toner P (comparative example 1-4), when toner P was used in printer 1, the fixation ratio was 80% at 155° C.; when toner P was used in printer 2, the fixation ratio was 80% at 175° C.; when toner P was used in printer 3, the fixation ratio was 80% at 185° C.; and when toner P was used in printer 4, the fixation ratio was 80% at 205° C. Regarding preservation of toner P, no blocking thereof occurred.

Regarding toner Q (comparative example 1-5), when toner Q was used in printer 1, the fixation ratio was 80% at 155° C.; when toner Q was used in printer 2, the fixation ratio was 80% at 175° C.; when toner Q was used in printer 3, the fixation ratio was 80% at 185° C.; and when toner Q was used in printer 4, the fixation ratio was 80% at 195° C. Regarding preservation of toner Q, no blocking thereof occurred.

Regarding toner R (comparative example 1-6), when toner R was used in printer 1, the fixation ratio was 80% at 165° C., when toner R was used in printer 2, the fixation ratio was 80% at 185° C., when toner R was used in printer 3, the fixation ratio was 80% at 195° C., when toner R was used in printer 4, the fixation ratio was 80% at 205° C. Regarding preservation of toner R, no blocking thereof occurred.

Regarding toner S (comparative example 1-7), when toner S was used in printer 1, the fixation ratio was 80% at 155° C.; when toner S was used in printer 2, the fixation ratio was 80% at 175° C.; when toner S was used in printer 3, the fixation ratio was 80% at 185° C.; and when toner S was used in printer 4, the fixation ratio was 80% at 195° C. Regarding preservation of toner S, no blocking thereof occurred.

Regarding toner T (comparative example 1-8), when toner T was used in printer 1, the fixation ratio was 80% at 165° C.; when toner T was used in printer 2, the fixation ratio was 80% at 185° C.; when toner T was used in printer 3, the fixation ratio was 80% at 195° C.; and when toner T was used in printer 4, the fixation ratio was 80% at 205° C. Regarding preservation of toner T, no blocking thereof occurred.

Regarding toner U (comparative example 1-9), when toner U was used in printer 1, the fixation ratio was 80% at 165° C.; when toner U was used in printer 2, the fixation ratio was 80% at 185° C.; when toner U was used in printer 3, the fixation ratio was 80% at 195° C.; and when toner U was used in printer 4, the fixation ratio was 80% at 205° C. Regarding preservation of toner U, no blocking thereof occurred.

As described above, according to the embodiment, a preferable toner has the following characteristic. In the molecular weight distribution of the tetrahydrofuran soluble portion of the toner measured by a gel permeation chromatography, the main peak is in a range equal to or greater than $2\times10^3$ and equal to or less than $3\times10^4$ weight-average molecular weight (Mw), the shoulder peak is in a range equal to or greater than 200 and equal to or less than 500, and the half-value width of the main peak is in a range equal to or less than 50000 weight-average molecular weight (Mw). Glass-transition point Tg of the toner measured by a differential scanning calorimeter DSC is equal to or greater than 55° C. and equal to or less than 80° C.

If the preferable toner is used to print and a printer having heat roller 32 whose circumferential velocity is equal to or greater than 162 mm/s and equal to or less than 189 mm/s, the fixation ratio of the toner is equal to or greater than 80% when the fixing temperature is equal to or less than 175° C. That is, the fixation property of the toner is improved.

Further, even though toner cartridge 16 containing therein the toner is left under a condition of high temperature and high humidity for one month, an occurrence of blocking of the toner is prevented. Therefore, the preservation property of the toner is improved while the fixation property is maintained for along period of time.

Next, a second embodiment of the invention is described. Note that the configuration of the printer of the second embodiment has the same configuration as that of the first embodiment, and thereby the second embodiment is described with reference to FIG. 1.

In the second embodiment, flow tester measurements for toners D to O were executed using printer 3 and using flow tester "CFT-500d" (manufactured by Shimazu Corporation). Printer 3 has heat roller 32 (a first roller) whose circumferential velocity (the liner velocity of fixing unit 30) is in a range from 162 mm/s to 189 mm/s. Each toner D to O had the characteristic wherein the fixation ratio was equal to or greater than 80% at the fixing temperature of 175° C. and no blocking thereof occurred.

Further, pellets for the flow tester were 1 g, the temperature rise rate was 3° C./min, the load for the sample was 10 kg, and the diameter was 1 mm. Note that flow tester melt point Tm, which is a melt point measured by the flow tester, is defined as the middle value between a melt/flow-out start temperature and a melt/flow-out end temperature upon melting and flowing out.

FIG. 4 shows the experimental result from the flow tester according to the second embodiment of the invention.

Flow tester melt point Tm of toner D was 110° C. (example 2-1), melt point Tm of toner E was 123° C. (example 2-2), melt point Tm of toner F was 140° C. (example 2-3), melt point Tm of toner G was 143° C. (comparative example 2-1), melt point Tm of toner H was 146° C. (comparative example 2-2), melt point Tm of toner I was 148° C. (comparative example 2-3), melt point Tm of toner J was 136° C. (example 2-4), melt point Tm of toner K was 143° C. (comparative example 2-4), melt point Tm of toner L was 138° C. (example 2-5), melt point Tm of toner M was 140° C. (example 2-6), melt point Tm of toner N was 146° C. (comparative example 2-5), and melt point Tm of toner O was 145° C. (comparative example 2-6).

As shown in FIG. 4, when printer 3 having heat roller 32 whose circumferential velocity is in the range from 162 mm/s to 189 mm/s was used, flow tester melt points Tm of the toners whose fixation ratios were equal to or greater than 80% when the fixing temperature is a range equal to or less than 165° C. were equal to or greater than 110° C. and equal to or less than 140° C.

As described above, according to the second embodiment, a fixation ratio is equal to or greater than 80% even when a fixing temperature is equal to or less than 165° C. thereby improving a fixation property, if printing is executed by a printer having heat roller 32 whose circumferential velocity is in the range between 162 mm/s and 189 mm/s using a toner whose glass-transition point Tg measured by a differential scanning calorimeter DSC is in a range from 55° C. and 80° C. and whose flow tester melt point Tm is in a range from 110° C. and 140° C. and whose tetrahydrofuran soluble portion has a molecular weight distribution measured by gel permeation chromatography wherein the main peak is a range from $2\times10^3$ and $3\times10^4$ weight-average molecular weight (Mw), the half-value width of the main peak is in a range equal to or less than 50000 weight-average molecular weight (Mw), and the shoulder peak is in a range from 200 to 500 weight-average molecular weight (Mw).

Further, even though toner cartridge 16 (serving as a developer container or a developer cartridge) containing the toner is left under a condition of high temperature and high humidity for one month, blocking of the toner is prevented thereby improving the preservation property of the toner.

Note that the binder resin used for the toner according to the embodiments includes thermal plastic resin such as vinyl resin, polyamide resin, and polyester resin. A monomer for vinyl resin include stylenes such as stylene, 2,4-dimethylstylene, α-methylstylene, p-ethylstylene, O-methylstylene, m-methylstylene, p-methylstylene, p-chlorostylene, vinylnaphthalene, or styrene derivatives; ethylenic monocarboxylic acids such as 2-ethylehexylacrylate, methyl methacrylate, methyl acrylate, ethyl acrylate, n-propyl acrylate, isobutyl acrylate, t-butyl acrylate acrylic-t-butyl, amyl acrylate, cyclohexyl acrylate, n-octylacrylate, isooctyl acrylate, decylacrylate, lauryl acrylate, stearyl acrylate, methoxyethyl acrylate, 2-hydroxyethyl acrylate, glycidyl acryalte, phenyl acrylate, chloromethyl acrylate, methacrylic acid, ethyl methacrylate, n-propyl methacrylate, isopropyl methacrylate, n-butyl methacrylate, isobutyl ethacrylate, t-butyl methacrylate, amyl methacrylate, cyclohexyl methacrylate, n-octyl methacrylate, isooctyl methacrylate, decyl, ethacrylate, lauryl methacrylate, 2-ethyl hexyl methacrylate, stearyl methacrylate, hydroxyethyl-2-methacrylate, 2-ethyl hexyl methacrylate, glycidyl methacrrylate, phenyl methacrylate, dimetyl amino methacrylate, and dietyl amino methacrylate, and esters of these ethylenic monocarboxylic acids; ethylenic unsaturated monoolefins such as ethylene, propylene, butylene, and isobutylene; vinyl esters such as vinyl chloride, vinyl bromoacetate, vinyl propionate, vinyl formate, vinyl caprorate; ethylenic monocarboxylic acids and its substitution such as acrylate nitrile, methacrylonitrile, and acrylamide; ethylenically dicarboxylic acid and its substitution product, for example, vinyl ketones such as vinyl methyl ketone and vinyl methyl ethers such as vinyl ethyl ether.

A cross-linking agent includes divinylbenzene, divinyl naphthalene, polyethylene glycol dimethacrylate, 2,2'-bis-(4-methacryloxydiethoxydiphenyl) propane, 2,2'-bis-(4-acryloxydiethoxydiphenyl) propane, diethylene glycol diacrylate, triethylene glycol diacrylate, 1,3-butylenglycol dimethacrylate, 1,6-hexylene glycol dimethacrylate, neopentyl glycol dimethacrylate, dipropylene glycol dimethacrylate, polypropylene glycol dimethacrylate, trimethylolpropane trimethacrylate, trimethylolpropane triacrylate, and tetramethylolmethanetetraacrylate. Alternatively, more than one of these cross-linking agents may be combined.

Further, an inorganic powder includes: metallic oxide such as zinc, aluminum, cerium, cobalt, iron, zirconium, chrome, manganese, strontium, tin, or antimony; combined metal oxide such as calcium titanate, magnesium titanate, or strontium titanate; metallic salt such as barium sulfate, calcium carbonate, magnesium carbonate, or aluminum carbonate; clay mineral such as kaolin; phosphate compound such as apatite; silicon compound such as silica, silicon carbide, or silicon nitride; or carbon powder such as carbon black or graphite.

The above embodiment is applied to the printer serving as an image forming apparatus; the invention, however, can be applied to a copy machine, a facsimile machine, a multifunction peripheral, or the like.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. A developer comprising:

a toner including toner mother particle comprising at least a binder resin; and an additive agent on the surface of the toner mother particle, wherein (a) in a molecular weight distribution of a tetrahydrofuran soluble portion of the toner measured by gel permeation chromatography, the main peak is in a range from $2\times10^3$ to $3\times10^4$ weight-average molecular weight (Mw) and the shoulder peak is in a range of not less than 200 and less than 500 weight-average molecular weight (Mw), (b) a half-value width of the main peak is equal to or less than 50000 weight-average molecular weight (Mw), and (c) a glass-transition temperature, Tg, of the toner measured by differential scanning calorimeter DSC is in a range from 55° C. to 80° C.

2. The developer of claim 1, wherein the binder resin is a copolymer of styrene and acrylic.

3. The developer of claim 1, wherein the additive agent includes at least silica.

4. The developer of claim 3, wherein the additive agent further includes at least oxidized titanium.

5. The developer of claim 1, wherein the developer consists of the toner and serves as a single-component developer.

6. The developer of claim 1, wherein the half-value width of the main peak is more than 15000 and equal to or less than 50000 weight-average molecular weight (Mw).

7. The developer of claim 1, wherein in the molecular weight distribution of the tetrahydrofuran soluble portion of the toner measured by gel permeation chromatography, the main peak is in a range of more than $1\times10^4$ and not more than $3\times10^4$ weight-average molecular weight (Mw) and the shoulder peak is in a range of not less than 200 and less than 500 weight-average molecular weight (Mw).

8. The developer of claim 1, wherein a flow tester melt point of the toner is in a range of not less than 110° C. and not more than 140° C.

* * * * *